US005503574A

United States Patent [19]

Louridas

[11] Patent Number: 5,503,574

[45] Date of Patent: Apr. 2, 1996

[54] BATTERY CABLE CONNECTOR

[76] Inventor: Panagiotis Louridas, 2101 Islington Ave. Unit #2006, Weston, Ontario, Canada, M9P 3R2

[21] Appl. No.: 254,865

[22] Filed: Jun. 6, 1994

[51] Int. Cl.[6] ..... H01R 4/46; H01R 4/40; H01R 4/50

[52] U.S. Cl. ..... 439/767; 439/769; 439/773

[58] Field of Search ..... 439/767, 769, 439/770, 773

[56] References Cited

U.S. PATENT DOCUMENTS

| | | | |
|---|---|---|---|
| 1,851,359 | 3/1932 | Hough | 439/769 OR |
| 1,855,683 | 4/1932 | McCleary | 439/769 OR |
| 1,868,939 | 7/1932 | Conrad | 439/769 OR |
| 4,964,819 | 10/1990 | Caraballo | 439/773 OR |
| 5,254,020 | 10/1993 | Obligar | 439/773 X |

*Primary Examiner*—P. Austin Bradley

*Assistant Examiner*—Daniel Wittels

[57] ABSTRACT

A battery cable connector connects a battery cable to a battery post. The connector comprises first and second outer connector portions and a third intermediate connector portion trapped between the first and second connector portions. The first and third connector portions have opposing battery post receiving recesses. The second connector portion is adjustably secured to the first connector portion by a threaded adjustment on which the third connector portion is slideably mounted. Also provided is a pusher member movable to and from a connector tightening position. The threaded adjustment provides an initial tightening of the connector around the post with the pusher member away from the tightening position. The pusher member is then moved to the tightening position where it pushes the third connector portion away from the second connector portion and towards the first connector portion to provide a tight fit of the first and third connector portions around the battery post.

3 Claims, 4 Drawing Sheets

BATTERY CABLE CONNECTOR

FIELD OF THE INVENTION

The present invention relates to a connector for connecting a battery cable to a battery post.

BACKGROUND OF THE INVENTION

A typical battery cable connector is in the form of a unitary clamp which is secured to the battery post by a nut secured to a bolt which extends generally tangentially of the connector. The connector is tightened by a tool typically in the form of a wrench.

Corrosion and dirt build-up occurs around the battery post which can adversely affect the contact of the connector on the post. In order to remove the connector, one must have the appropriate tool in hand and even when a tool is available, the connector can sometimes be difficult to remove because the corrosion can bind the nut on the bolt.

SUMMARY OF THE INVENTION

The present invention relates to a connector aimed at overcoming the drawbacks noted above. In particular, the connector of the present invention which connects a battery cable to a battery post comprises first and second outer connector portions and a third intermediate connector portion located between the first and second connector portions. The first connector portion is secured to the battery cable and the first and third connector portions have opposing battery post receiving recesses for fitting around the post. The second connector portion is adjustably secured to the first connector portion by a threaded adjustment on which the third connector portion is slideably mounted. Also provided is a pusher member movable to and from a connector tightening position.

when the pusher member is away from the tightening position, the threaded adjustment is used to provide an initial relatively loose securing of the connector to the battery post and thereafter, the pusher is moved to the tightening position where it pushes the third connector portion inwardly away from the second connector portion towards the first connector portion such that the first and third connector portions clamp tightly around the battery post.

BRIEF DESCRIPTION OF THE DRAWINGS

The above as well as other advantages and features of the present invention will be described in greater detail according to the preferred embodiments of the present invention in which.

DESCRIPTION ACCORDING TO THE PREFERRED EMBODIMENTS OF THE PRESENT INVENTION

Figure 1:
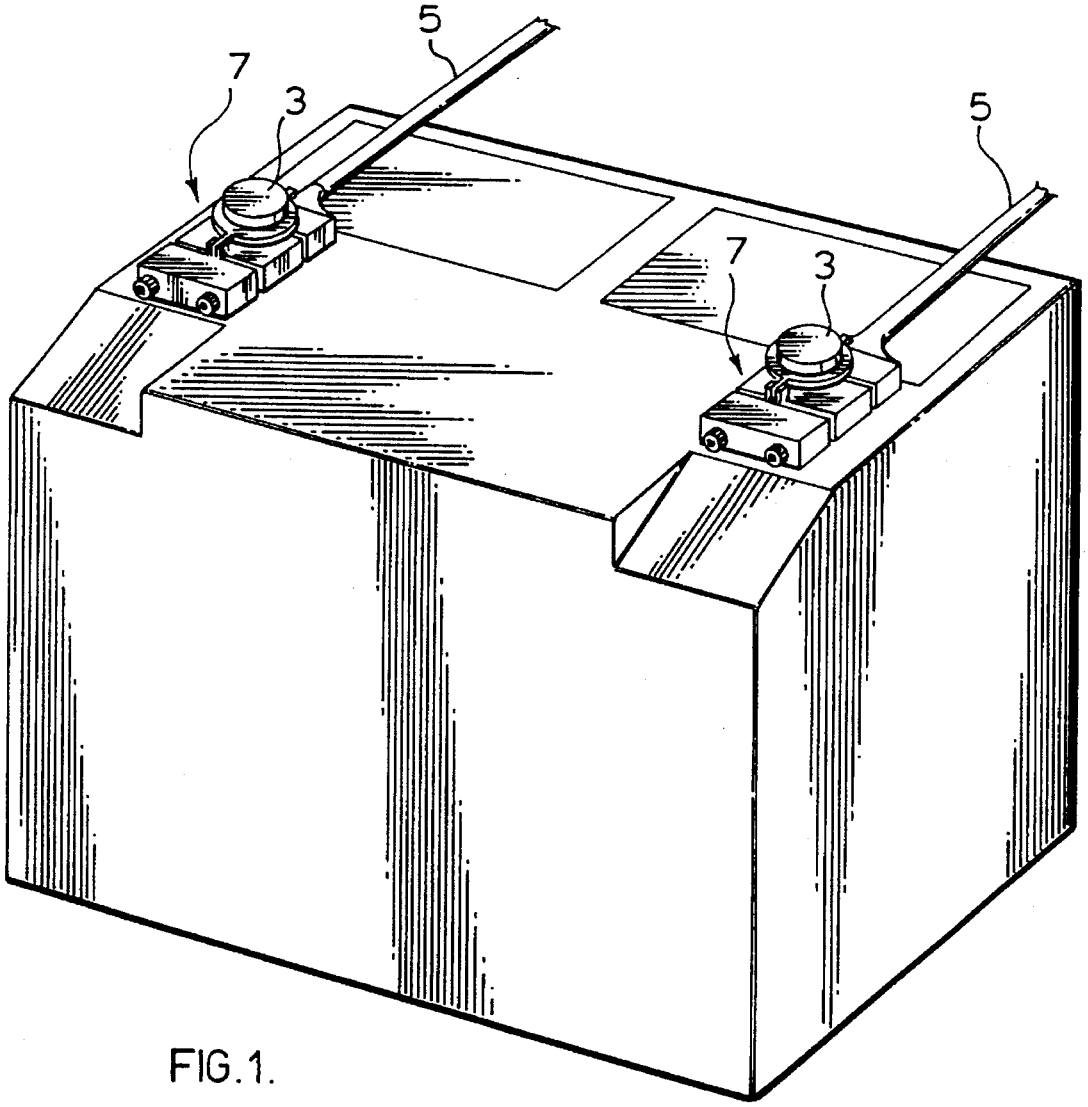
FIG. 1 is a perspective view of a battery fitted with a pair of connectors according to a preferred embodiment of the present invention.

FIG. 1 shows a battery 1 having a pair of battery posts 3. A pair of cables 5, one for power and one for ground are connected to the posts 3 by means of cable connectors generally indicated at 7.

Figure 2:
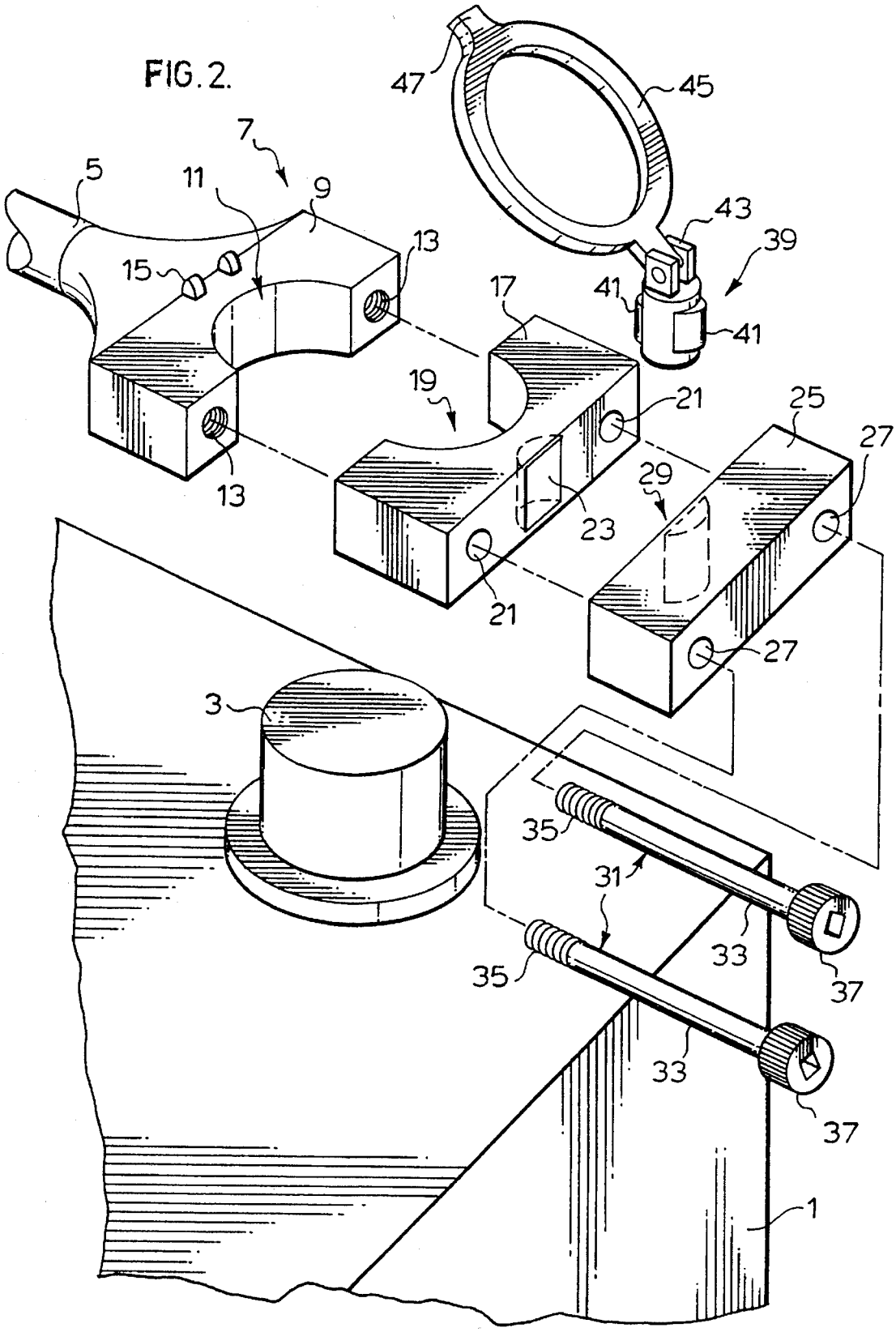
FIG. 2 is an enlarged exploded perspective view of one of the connectors from the battery of FIG. 1.

FIG. 2 shows the details of connector 7. This connector comprises first and second outside connector portions 9 and 25 and a third intermediate connector portion 17 trapped between the first and second connector portions. Connector portion 9 includes a semi-circular recess 11 and connector portion 17 includes a corresponding semi-circular recess 19 which faces recess 11 to provide a circular opening into which battery post 3 is fitted.

The first connector portion 9 which is secured directly to battery cable 5 includes a pair of threaded openings 13. It additionally includes a pair of upstanding lugs 15.

The third connector portion 17 includes a pair of smooth walled openings 21 extending completely through this particular connector portion. The openings 21 in the third connector portion align with the threaded openings 13 in the first connector portion.

The back face of the third connector portion 17, i.e. the face away from recess 19 includes a smaller semi-circular recess 23. This recess does not run the entire height of the third connector portion but rather is bordered at its upper and lower ends as best seen in FIG. 2 of the drawings.

The second connector portion 25 includes a pair of smooth walled openings 27 which run completely through the connector portion. These openings 27 align with the openings 21 in the third connector portion.

The second connector portion 25 has a semi-circular recess 29 identical to and facing the recess 23 in the third connector portion.

The connector further includes a pair of elongated bolts 31, each of which has smooth body portion 33, a threaded inner end 35 and a knurled head 37. These bolts fit through the openings 27 and 21 in the second and third connector portions and thread into the openings 13 in the first connector portion.

Also provided is a cam generally indicated at 39. This cam is trapped in the opposing recesses 29 and 23 of the second and third connector portions. The cam includes raised cam shoulders 41 with flats between the shoulders. Also provided with the cam is a lever 45 which is pivotally secured at the upper end 43 of the cam. Lever 45 includes a lever extension 47.

Figure 3:
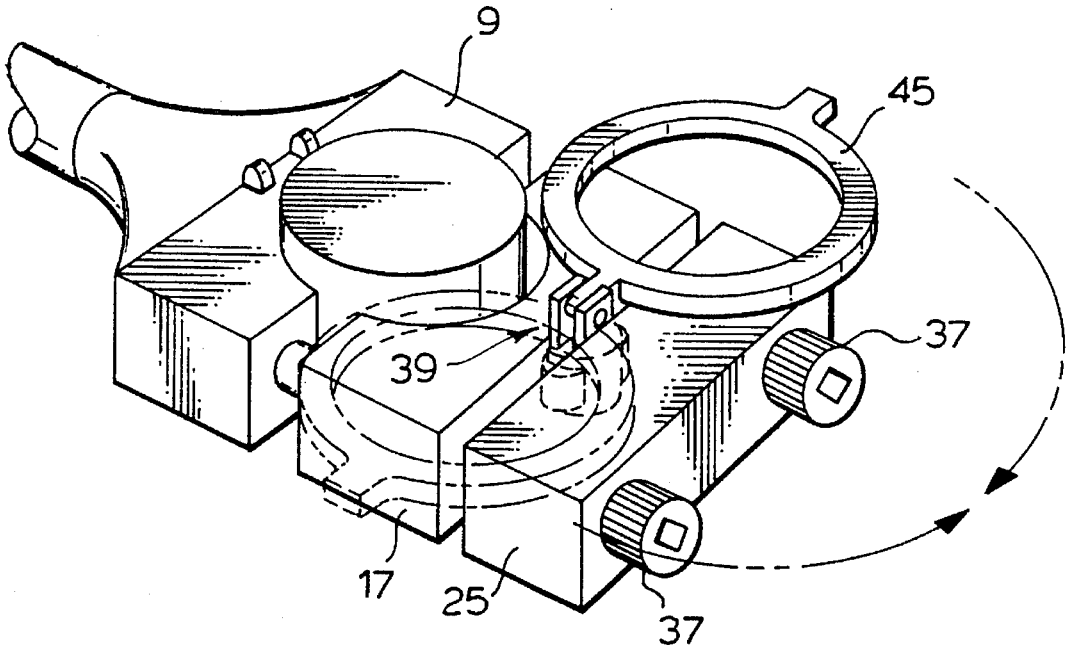
FIG. 3 is a top perspective view of the connector of FIG. 2 as initially and relatively loosely fitted to the battery post.

FIG. 3 shows the connector as it is initially fitted over the battery post. As will be seen in FIG. 3, the connector is loose and can easily slide on and off of the post.

A feature to be noted in FIG. 3 is that when the connector is loosely fitted on the post, lever 45 extends out to one side of the connector. It can be set in either the solid line position of FIG. 3 or the dotted line position of FIG. 3. This allows either right or left hand access to the post depending upon where the battery is positioned under the hood of a car or the like.

The first step in tightening of the connector is by use of the two bolts 31 with the heads 37 of the bolts accessible to the outside of the second connector portion where they can be tightened. This can be done either by finger or tool tightening. Note that the bolt heads 37 include small openings 38 which enable tightening of the bolts by means of an ALLEN key which is very small and easily stored under the hood of the car. By tightening the two bolts, the second connector portion is pulled towards the first connector portion and slides the third connector portion along the smooth body portions of the bolts towards both the post and the first connector portion.

Figure 4:
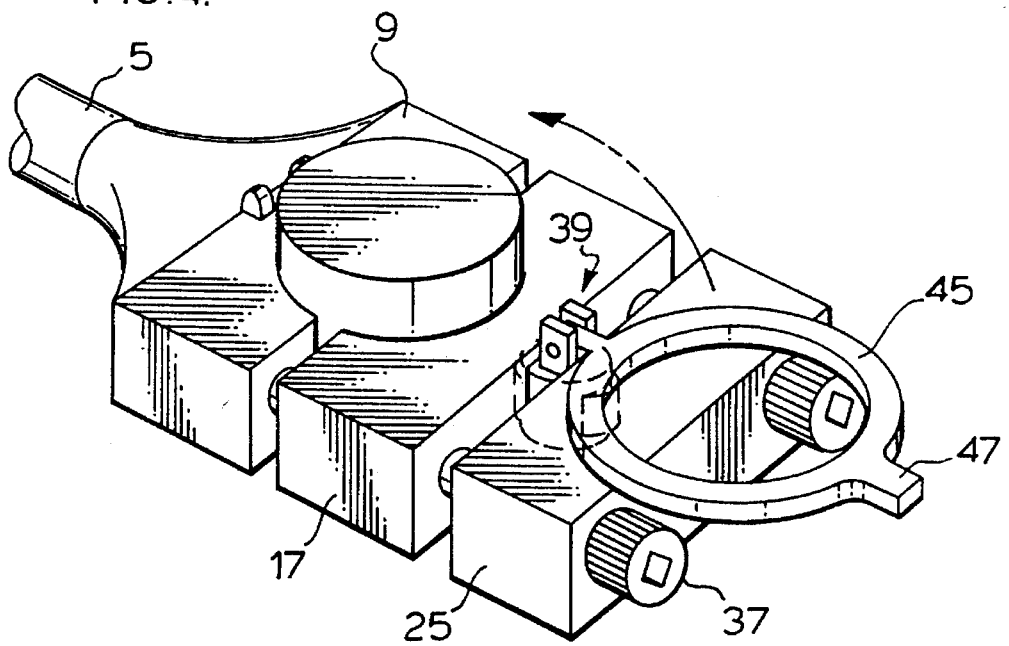
FIG. 4 is a view similar to FIG. 3 but with the connector in a tightened position on the post.
Figure 5:
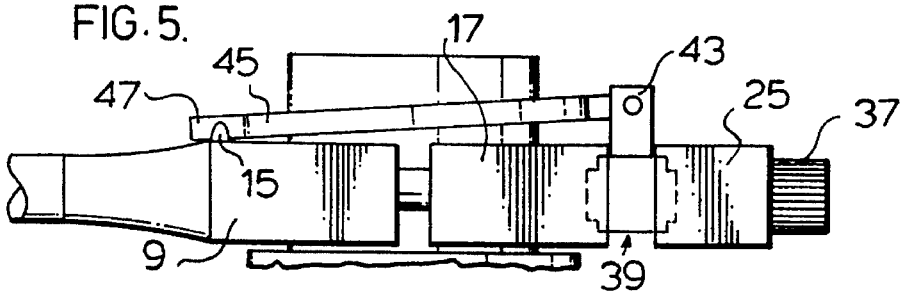
FIG. 5 is a side view of the connector in its final locked position on the battery post.

Once the connector has been tightened by an initial adjustment of bolts 31, lever 45 is moved horizontally through an angle of about 90° from the FIG. 3 to the FIG. 4 position. This rotates cam 39 from an initial setting where the flats of the cam face the second and third connector portions to a tightening position in which the raised shoulders of the cam face the second and third connector portions as best seen in FIG. 5 of the drawings. As the cam is rotated to the FIG. 4 position, pressure is applied on the third connector portion to slide tightly up against the battery post. This occurs because the second connector portion is held in its position by the bolts which are secured directly into the first connector portion which then forces the third connector portion along the smooth body portions 33 of the bolts.

After lever 45 has been moved to the FIG. 4 position, it can then be flipped over the battery post to its locked position as shown in FIG. 5 of the drawings. As will be seen, the flipping or vertical pivoting of the lever is allowed because of its pivotal connection to the upper end 43 of the cam as well seen in FIGS. 2 through 5 of the drawings. The circular loop construction of the lever allows it to fit down over the battery post and the extension 47 of the lever locks by a friction fit between the two upright lugs 15 on the first connector portion. This inhibits inadvertent release of the lever from its locked position.

In order to release the connector from the battery post, one simply has to flip the lever back from the FIG. 5 to the FIG. 4 position, and slide the lever sideways which then rotates the cam back to a position where pressure is released between the second and third connector portions. At this point, the connector without any adjustment of the bolts may be loose enough to remove it from the post and if the bolts need to be backed off they are once again easily accessible for either finger or tool loosening.

Figure 6:
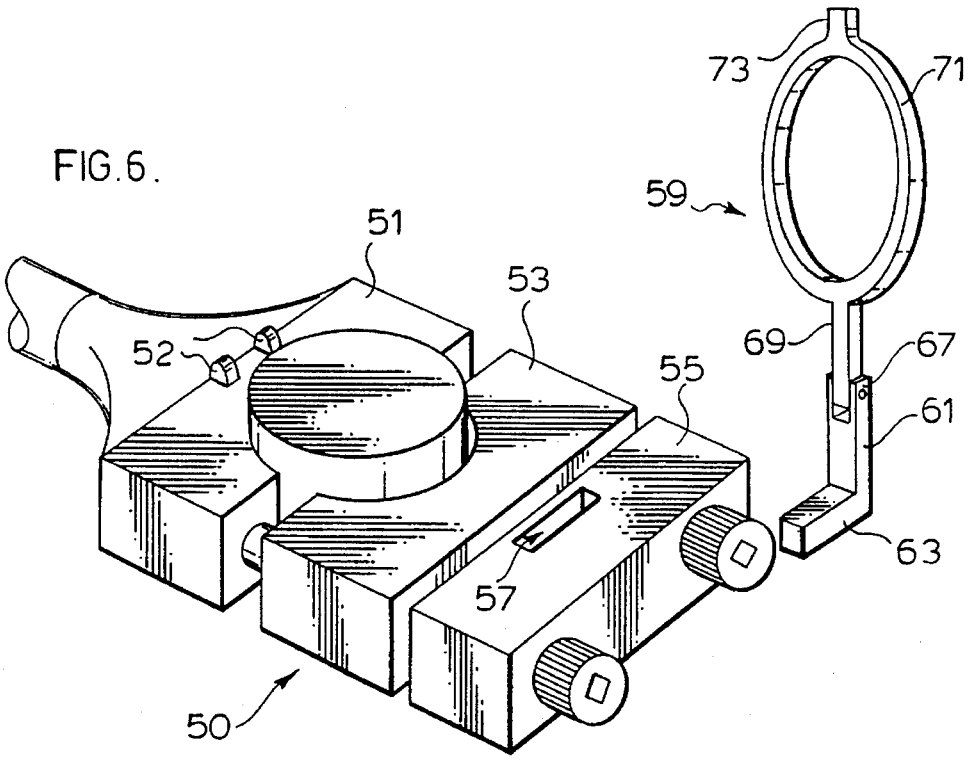
FIG. 6 is a perspective view of a battery post connector with a removable key according to a further preferred embodiment of the present invention.
Figure 7:
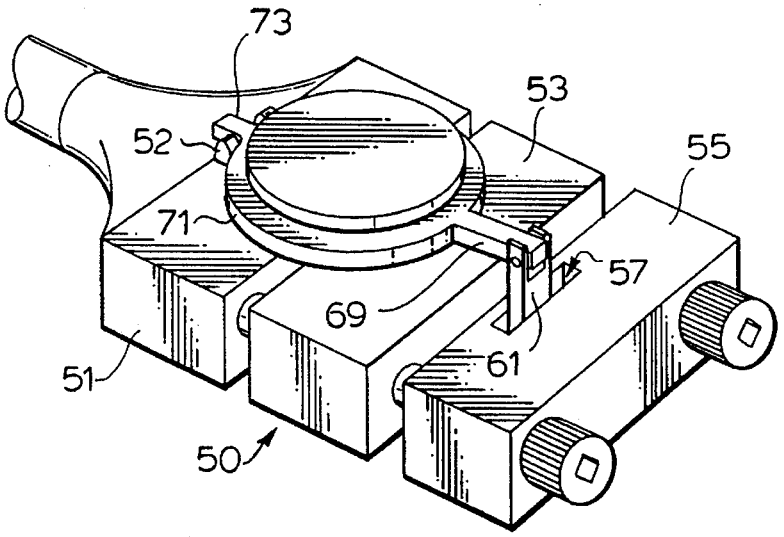
FIG. 7 is a perspective view of the connector of FIG. 6 with the key fitted in the connector.
Figure 8:
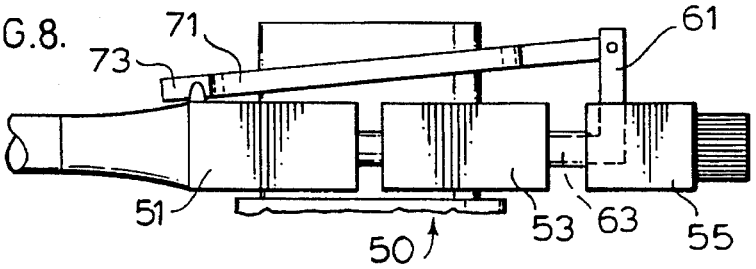
FIG. 8 is a side view of the connector of FIG. 7.

FIGS. 6 through 8 show a further preferred embodiment battery cable to battery post connector generally indicated at 50. This connector includes first and second outside connector portions 51 and 55 and a third intermediate connector portion 53 trapped between the two outer connector portions. Again, the first and third connector portions include semi-circular post receiving recesses facing one another to fit around the battery post as shown in FIGS. 6 and 7.

Like the earlier described embodiment, connector 50 includes threaded adjustment bolts between the first and second outside connector portions with the third intermediate connector portion being slideably mounted on the bolts.

In this particular embodiment, the pusher member to provide the final tightening of the connector is in the form of a key generally indicated at 59. The second connector portion 55 includes a key opening 57 to receive the key as described immediately below.

Key 59 has a lower end shaft 61 having an elongated foot 63. The upper end of the key comprises an upper shaft portion 69 and a circular key head 71 provided with an extension 73. The upper shaft portion 69 is pivotally secured at 67 to the lower shaft portion 61.

Key 59 is movable to and from a connector tightening position. When the key is away from the tightening position the bolts are adjusted to provide an initial tightening of the connector around the post.

The key opening 57 in connector portion 55 not only opens to the top of the connector portion but also opens from the side of the connector portion towards connector portion 53 much like the opening in a door lock. In order to move the key to the tightening position, it is rotated by the key head 59 such that the lower foot 63 is turned at 90° to the key opening 57 where it protrudes from the second connector portion 55 and pushes on the third connector portion 53 as seen in FIG. 8 of the drawings. This pushes the third connector portion tightly up against the battery post and provides a final tightening of the connector. The upper end of the key can then be pivoted downwardly at the pivot point between shaft portions 69 and 61 so that the key head 71 fits around the battery post. The upper extension 73 on the key head will then frictionally lock between the two lugs 52 on the first connector portion 51.

A very unique feature of the connector 50 is that the key 59, as well shown in FIG. 6 of the drawings, is completely removable from the remainder of the connector. This provides a number of benefits. Firstly, as a theft protection device, one can easily take the key from the battery, which will loosen the connector to the extent that it does not make proper contact with the post so that the car cannot be started by the battery. Secondly, the key the key is part of the connector, the tool is always available.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A connector which connects a battery cable to a battery post, said connector comprising first, second and third connector portions, said first connector portion being secured to the battery cable, said first and third connector portions having opposing battery post receiving recesses, said first and second connector portions being adjustably secured to one another by a threaded adjustment on which said third connector portion is slideably mounted between said first and second portions, and a pusher member movable to and from a connector tightening position, said threaded adjustment providing an initial tightening of said connector around the post with said pusher member away from the tightening position, said pusher member being movable to the tightening position to push said third connector portion away from said second connector portion and towards said first connector portion to provide a tight fit of the first and third connector portions around the battery post and wherein said pusher member comprises a key and said connector has a key opening in which said key is releasably secured, said key having a key head which pushes on said third connector portion when said pusher member is in the connector tightening position.

2. A connector as claimed in claim 1, wherein said key is provided with an outer end lever in the form of a loop and said key is bendable to fold said loop down over the battery post when said key is in the connector tightening position.

3. A connector as claimed in claim 1, wherein said pusher member comprises a cam operated by a lever said lever comprises a circular loop and said pusher member is bendable to fold said circular loop down over the battery post when said pusher member is in the connector tightening position.

* * * * *